US011573030B2

(12) United States Patent
Rockhold et al.

(10) Patent No.: US 11,573,030 B2
(45) Date of Patent: Feb. 7, 2023

(54) SYSTEM FOR LOUVER ASSEMBLY BLADE REINFORCEMENT

(71) Applicant: Air Distribution Technologies IP, LLC, Milwaukee, WI (US)

(72) Inventors: Joseph S. Rockhold, Bates City, MO (US); Melissa M. Massar, Lee's Summit, MO (US); Christopher J. Driskell, Lee's Summit, MO (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 80 days.

(21) Appl. No.: 16/143,267

(22) Filed: Sep. 26, 2018

(65) Prior Publication Data

US 2020/0049370 A1 Feb. 13, 2020

Related U.S. Application Data

(60) Provisional application No. 62/715,653, filed on Aug. 7, 2018.

(51) Int. Cl.

| | |
|---|---|
| ***F24F 13/15*** | (2006.01) |
| ***F24F 13/08*** | (2006.01) |
| ***F24F 13/14*** | (2006.01) |

(52) U.S. Cl.

CPC ..... *F24F 13/15* (2013.01); *F24F 13/084* (2013.01); *F24F 13/1413* (2013.01)

(58) Field of Classification Search

CPC ..... F24F 13/15; F24F 13/084; F24F 13/1413; F24F 13/0209; E06B 7/082

USPC ..... 49/51; 52/213, 215; 454/282, 281, 331

See application file for complete search history.

(56) References Cited

U.S. PATENT DOCUMENTS

| | | | | |
|---|---|---|---|---|
| 3,968,738 | A * | 7/1976 | Matzke | E06B 7/082 454/309 |
| 5,924,255 | A * | 7/1999 | Vagedes | E06B 9/04 403/331 |
| 6,119,757 | A * | 9/2000 | Judkins | E06B 9/303 160/173 R |
| 6,447,876 | B1 * | 9/2002 | Robinson | B63J 2/10 428/167 |
| 6,536,174 | B2 | 3/2003 | Foster et al. | |
| 6,672,195 | B1 * | 1/2004 | Plattner | F41H 7/035 89/36.11 |
| 6,877,285 | B2 | 4/2005 | Poma et al. | |
| 7,222,456 | B1 | 5/2007 | Carey | |
| 8,360,131 | B2 * | 1/2013 | Kashani | E06B 3/721 160/213 |
| 8,528,254 | B1 | 9/2013 | Johnston | |
| 9,574,392 | B2 | 2/2017 | Alexander | |
| 2004/0010972 | A1 * | 1/2004 | Crozzoli | E06B 7/082 49/63 |

(Continued)

*Primary Examiner* — Steven B McAllister
*Assistant Examiner* — Cole N Friedman
(74) *Attorney, Agent, or Firm* — Fletcher Yoder, P.C.

(57) ABSTRACT

A louver assembly includes a support, a plurality of blades, and an insert. The support extends along a length and includes a plurality of slots formed therethrough. Additionally, each louver blade of the plurality of louver blades includes a retention aperture formed therethrough, where each louver blade of the plurality of louver blades extends through a respective blade aperture of the plurality of blade apertures. Moreover, the insert extends through the retention aperture of each louver blade of the plurality of louver blades.

22 Claims, 5 Drawing Sheets

(56) References Cited

U.S. PATENT DOCUMENTS

2010/0317281 A1* 12/2010 Sperandio ..... E06B 7/082
454/224
2016/0215999 A1* 7/2016 Bard ..... H05K 7/20181

* cited by examiner

SYSTEM FOR LOUVER ASSEMBLY BLADE REINFORCEMENT

CROSS REFERENCE TO RELATED APPLICATIONS

This application claims priority from and the benefit of U.S. Provisional Application Ser. No. 62/715,653, entitled "SYSTEM FOR LOUVER ASSEMBLY BLADE REINFORCEMENT," filed Aug. 7, 2018, which is hereby incorporated by reference in its entirety for all purposes.

BACKGROUND

The disclosure relates generally to heating, ventilation, and air conditioning (HVAC) systems, and specifically, to a louver assembly that enables air to be directed through an HVAC system.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial applications to control environmental properties, such as temperature and humidity, for occupants of respective environments. The HVAC system may control the environmental properties through control of an air flow delivered to and ventilated from spaces serviced by the HVAC system. For example, an HVAC system may transfer heat between the air flow and refrigerant flowing through the system. The air flow may be directed through the HVAC system via a louver assembly. The louver assembly may include blades that are implemented to block unwanted particles, such as debris, from flowing through the louver assembly. It is now recognized that an impact of certain debris against the blades of the louver assembly may affect a position of the blades on the louver assembly.

SUMMARY

In one embodiment, a louver assembly includes a support, a plurality of blades, and an insert. The support extends along a length and includes a plurality of slots formed therethrough. Additionally, each louver blade of the plurality of louver blades includes a retention aperture formed therethrough, where each louver blade of the plurality of louver blades extends through a respective blade aperture of the plurality of blade apertures. Moreover, the insert extends through the retention aperture of each louver blade of the plurality of louver blades such that a length of the insert extends along the length of the support.

In another embodiment, a louver assembly includes a jamb frame that includes a base and arms extending laterally from opposite ends of the base, where each arm includes a recess. The louver assembly also includes a support, a plurality of blades, and an insert. The support includes a plurality of blade apertures formed therethrough, where the support extends into the recess of each arm of the jamb frame. Additionally, each blade of the plurality of blades includes a retention aperture formed therethrough, where each blade of the plurality of blades extends through a respective blade aperture of the plurality of blade apertures. The insert extends through the retention aperture of each blade.

In another embodiment, a louver assembly for a heating, ventilation, and/or air conditioning (HVAC) system includes a support that includes a plurality of louver blade apertures formed therethrough. The louver assembly also includes a plurality of louver blades, where each louver blade of the plurality of louver blades includes a retention aperture formed therethrough, where each louver blade of the plurality of louver blades extends through a respective louver blade aperture of the plurality of louver blade apertures. In addition, an insert extends through the retention aperture of each louver blade of the plurality of louver blades, where the insert is mechanically secured to the support.

DRAWINGS

DETAILED DESCRIPTION

Figure 1:
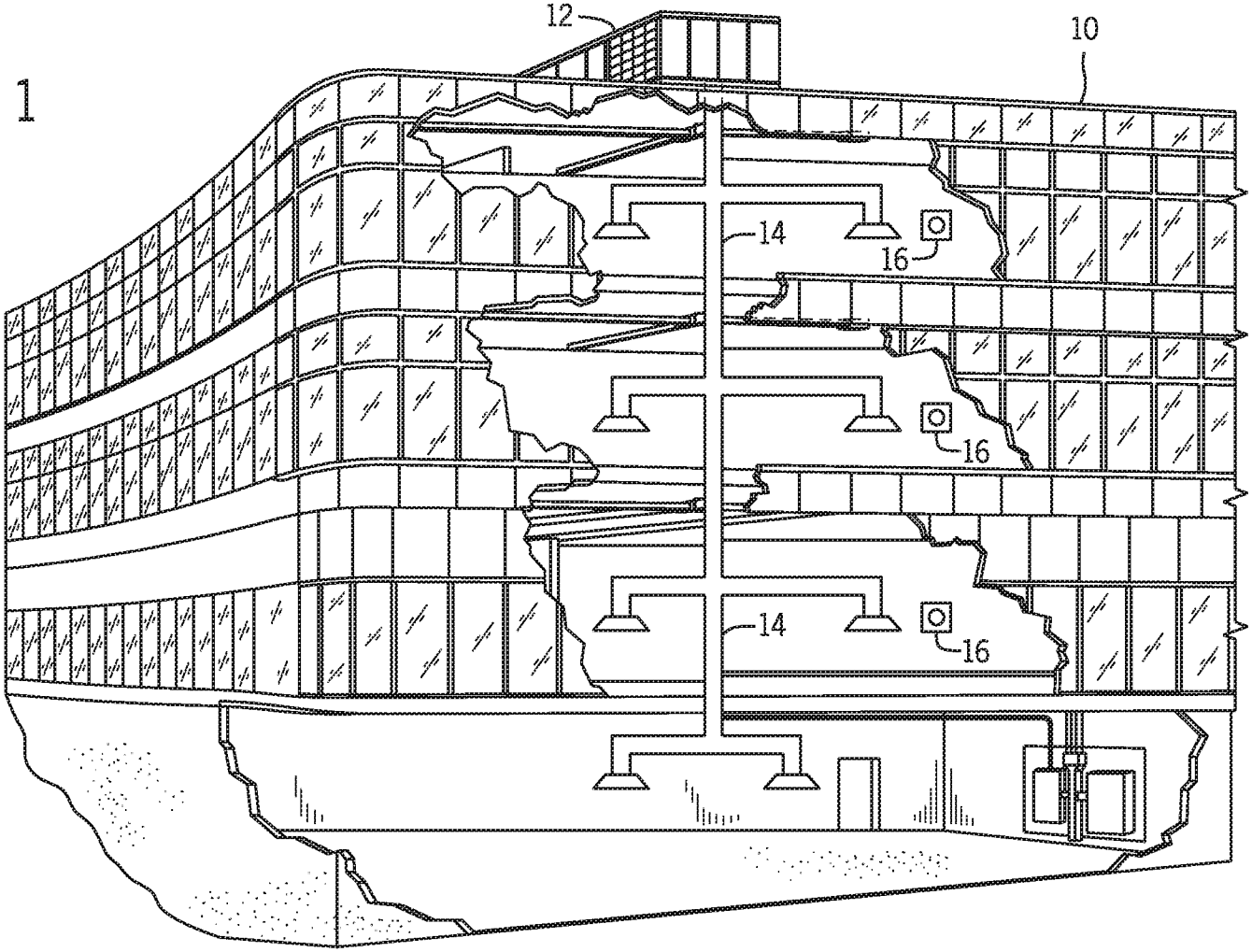
FIG. 1 is a perspective view of an embodiment of a building that may utilize a heating, ventilation, and air conditioning (HVAC) system in a commercial setting, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is directed to a louver assembly for a heating, ventilation, and air conditioning (HVAC) system. The louver assembly may enable an air flow to be directed into the HVAC system, where the HVAC system may condition the air flow by adding and/or removing heat from the air flow. For example, the louver assembly may be positioned at an inlet of a unit of the HVAC system. The louver assembly may additionally or alternatively enable the air flow to be directed out of the HVAC system, where the air flow may condition a space serviced by the HVAC system. Further, the louver assembly may enable the air flow to be directed within the HVAC system, such as between different components of the HVAC system.

The louver assembly may include a frame and blades secured to the frame. The frame may be coupled to another component of the HVAC system, such as an air handler, ductwork, and/or a heat exchanger, to enable air to be directed through the HVAC system. The blades may be disposed in the frame and may be positioned at an angle to block unwanted particles, including precipitation, dirt, and/or other debris, from being directed through the louver assembly and into the HVAC system, where the unwanted particles may affect a performance of the HVAC system. In certain existing louver assemblies, the blades may be coupled to the frame, such as by being inserted through the frame. However, an impact of certain debris may affect the positioning of the blades. For example, debris that impacts a blade at a particular force and/or at a particular direction may possibly displace the blade. A displacement of the blade from the frame may produce an opening in the louver assembly that enables unwanted particles to flow through the louver assembly and may generally affect an integrity of the louver assembly. As a result, an increased amount of unwanted particles may flow through the louver assembly and into the HVAC system, which may impact performance or operation of the HVAC system.

Thus, in accordance with certain embodiments of the present disclosure, it is presently recognized that improving securement of the blades to the frame of the louver assembly may enable the blades to withstand impact of certain debris. Specifically, ends of each blade may be inserted into blade apertures of respective end supports of a jamb frame of the louver assembly. The respective ends of each blade may also include a retention aperture. When the blades are positioned in the end supports, the respective apertures of each blade may align with one another. A retention insert or strip may be positioned through the respectively aligned apertures of the blades to secure each blade to the end supports and the jamb frame. Furthermore, the retention insert may be coupled or fastened to an adjacent end support and further secure the blade to the end supports. As used herein, an aperture refers to any opening that may extend at least partially through the end support and/or blade, and an aperture may include a slot, an orifice, a cavity, and so forth.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as a system that may include an outdoor HVAC unit and an indoor HVAC unit.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

As noted above, a louver assembly of an HVAC system may enable air flow to be directed into, through, and/or out of an HVAC system. For example, the louver assembly may couple to a component of the HVAC unit 12 to enable an air flow to be directed into the HVAC unit 12 from an ambient environment and/or direct out of the HVAC unit 12 to the ambient environment. In one embodiment, a louver assembly may be disposed on the ductwork 14 to enable an air flow to be directed to different rooms of the building 10 from the HVAC unit 12 and/or from different rooms of the building 10 to the HVAC unit 12. Additionally or alternatively, a louver assembly may be implemented to direct air through the HVAC system, such as within the ductwork 14 to enable the air flow to be directed between different sections of the ductwork 14.

In addition to directing the air flow into, through, and/or out of the HVAC unit 12, the louver assembly may also block or restrict unwanted particles, such as from the ambient environment, from flowing into the HVAC unit 12. As an example, the louver assembly may include a set of blades, where the blades are positioned to define openings through the louver assembly. Although the openings are sized to permit air flow to be directed through the louver assembly, the arrangement of the blades may block certain particles from flowing through the openings and into the HVAC unit 12. The blades may be coupled to a jamb frame of the louver assembly to maintain a position of the blades within the louver assembly. That is, the blades may be secured to the louver assembly to block movement of the blades and enhance the ability of the blades to block passage of particles across the louver assembly.

For example, each end of a blade may be inserted through a respective end support of the jamb frame. Additionally, a respective retention insert may extend through aligned apertures formed in each end of the blade to block the blades from being removed from the respective end support. Each respective retention insert may be coupled to an adjacent end support to further secure the blades to the jamb frame. For discussion purposes, the present disclosure is primarily focused on a louver assembly that includes blades that are fixed relative to the jamb frame. That is, a position of the blades generally may not be adjustable within the jamb frame to adjust a size of the openings of the louver assembly. However, it should be understood that in some embodiments, the present techniques may be incorporate in other embodiments or systems. For example, the present techniques may be utilized with a louver assembly or a damper configured to enable a certain degree of movement of the blades relative to the jamb frame. In other words, certain embodiments may include blades that are adjustable, for example, to adjust a size of the openings between the blades to increase or decrease a rate of air flow through the louver assembly.

Figure 2:
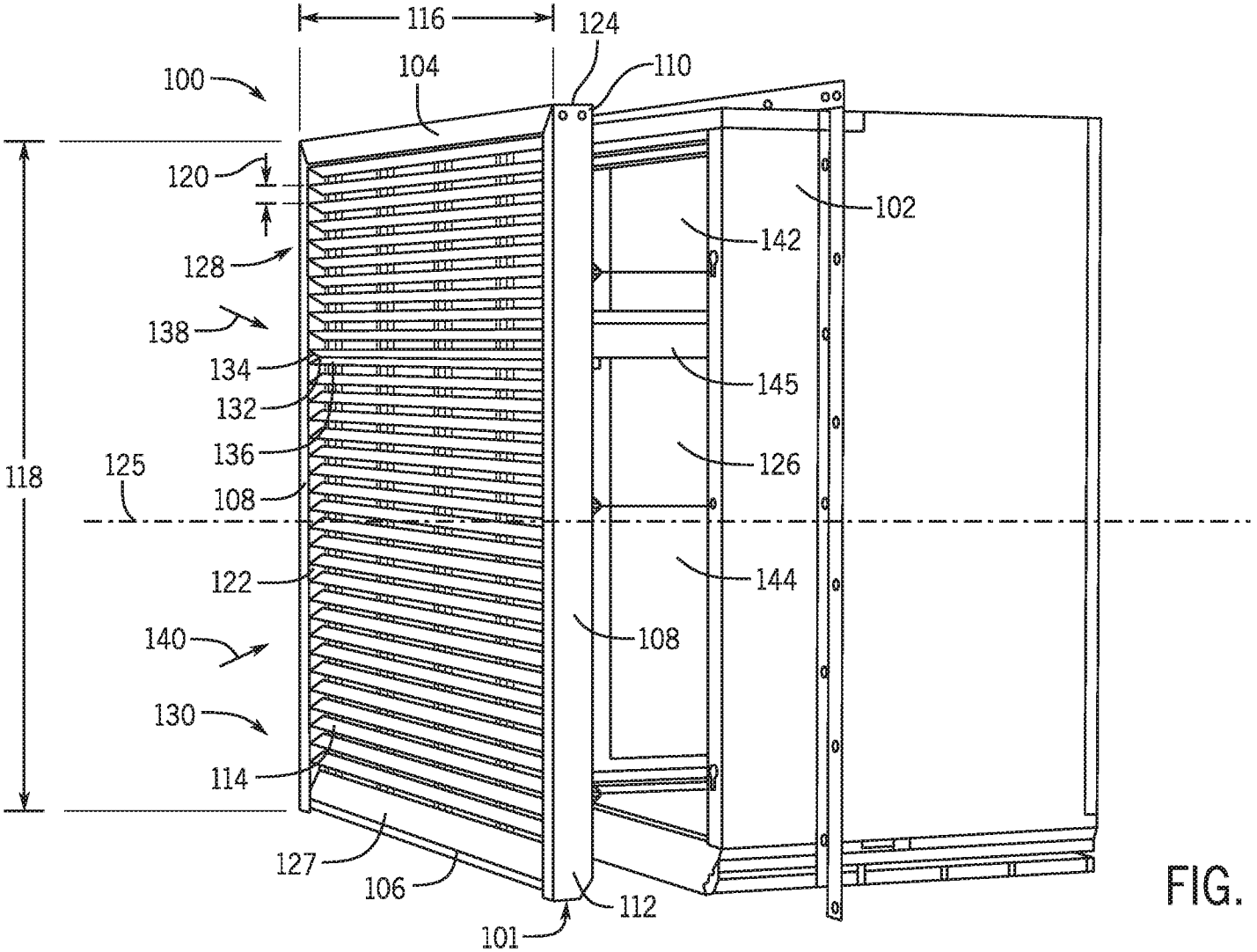
FIG. 2 is a perspective exploded view of an embodiment of a louver assembly implemented to direct air flow through a sleeve or unit of an HVAC system, in accordance with an aspect of the present disclosure.

FIG. 2 is an exploded perspective view of an embodiment of a louver assembly 100 and a sleeve 102 that may be included in the HVAC unit 12 of FIG. 1. For example, the louver assembly 100 may be coupled to the sleeve 102 to place the louver assembly 100 in fluid communication with another component of the HVAC unit 12. As previously described, the louver assembly 100 may direct air into, through, and/or out of the HVAC unit 12. To this end, the sleeve 102 may be disposed on a component of the HVAC unit 12 that the air is directed through, such as on a component to enable air to be directed between the component and an ambient environment, and/or between components to enable air to be directed between the components. For example, the sleeve 102 may be a part of a housing of a rooftop unit to direct an air flow between the HVAC unit 12 and an environment external to the HVAC unit 12. However, it should be appreciated that the louver assembly 100 may be coupled to other components through which air may flow, including a housing, a duct, a panel, or other component.

As depicted in FIG. 2, the louver assembly 100 may be generally rectangular in shape and may have an outer frame 101 extending about a perimeter or outer edge of the louver assembly 100. The outer frame 101 includes a first end frame 104 and a second end frame 106 positioned opposite and substantially parallel to the first end frame 104. The outer frame 101 also includes two jamb frames 108 that are positioned opposite and substantially parallel to one another on lateral sides of the louver assembly 100, where each jamb frame 108 is positioned substantially perpendicular to both the first end frame 104 and the second end frame 106. A first end 110 of each jamb frame 108 may be coupled to the first end frame 104 and a second end 112 of each jamb frame 108 may be coupled to the second end frame 106 to secure the components of the outer frame 101 to one another. Moreover, the first end frame 104, the second end frame 106, and/or the jamb frames 108 may be coupled to the sleeve 102, such as via fasteners, to secure the louver assembly 100 to the sleeve 102.

The louver assembly 100 also includes a plurality of blades 114. Each blade 114 may span a first length 116 or width between the two jamb frames 108 along a dimension of the first end frame 104 and/or the second end frame 106. The blades 114 may also be aligned along a second length 118 or height of the jamb frames 108, where each blade 114 may be positioned at a distance 120 away from adjacent blades 114 of the louver assembly 100. The first length 116 and/or the second length 118 may be based at least in part on a dimension of a component, such as the sleeve 102, to which the louver assembly 100 is coupled. In other words, the first length 116 and/or the second length 118 may be sized to accommodate a dimension of the sleeve 102. Specifically, the first length 116 and/or the second length 118 may be greater when a greater amount of air flow is desirable through the louver assembly 100. As an example, the first length 116 may be between 50 centimeters and 100 centimeters and the second length 118 may be between 70 centimeters and 120 centimeters. Although FIG. 2 illustrates that the second length 118 is greater than the first length 116, it should be appreciated that in certain applications of the louver assembly 100, the first length 116 may be greater than the second length 118 or the first length 116 may be approximately equal to the second length 118.

The louver assembly 100 includes openings 122 defined between adjacent blades 114, where each opening 122 extends along the first length 116 to enable air to flow through the louver assembly 100. A size of each opening 122 may be based on the distance 120 between adjacent blades 114. In certain embodiments, the distance 120 may vary between adjacent blades 114, such as between 1 centimeter and 5 centimeters. It should be understood that a greater distance 120 results in a larger opening 122 that may enable a greater amount of air to flow through the opening 122. Thus, the distance 120 may be based on a desired amount of air to be directed through the louver assembly 100. It should also be appreciated that the individual dimensions or sizes of the blades 114 may also be selected to achieve desired dimensions of the openings 122 and/or desired amounts of air flow through the louver assembly 100.

Additionally, the blades 114 may be disposed at an angle with respect to an edge 124 of the jamb frame 108, which may be generally horizontal when the louver assembly 100 is installed in the configuration shown in FIG. 2. In other words, the blades 114 may be disposed at an angle relative to a central axis 125 extending through the louver assembly 100. In this manner, the blades 114 may direct an air flow at a desired angle through the louver assembly 100, which may direct the air flow toward a center 126 of the sleeve 102. The angle of the blades 114 and/or a size of each opening 122 may block certain particles from flowing through the louver assembly 100, while enabling air flow to cross the louver assembly 100. That is, particles that are larger than the openings 122 may be unable to flow through the louver assembly 100. Additionally, particles traveling at certain angles may be blocked by the angled blades 114 from flowing through the louver assembly 100. In certain embodiments, certain blades 114 may be at different angles from one another. For example, a first portion or set 128 of blades 114 may be disposed at a first angle with respect to the edge 124 or central axis 125 and a second portion or set 130 of blades 114 may be at a second angle with respect to the edge 124 or central axis 125. The number of blades 114 in the first portion 128 may be the same or different as the number of blades 114 in the second portion 128.

In some embodiments, the blades 114 of the first portion 128 are disposed adjacent to one another or in a grouping along a section of the second length 118, and the blades 114 of the second portion 130 are disposed adjacent to one another or in a grouping along a remaining section of the second length 118. The louver assembly 100 may also include a transition blade 132 disposed between the first portion 128 of blades 114 and the second portion 130 of blades 114 along the second length 118. The transition blade 132 may include a first blade 134 coupled to a second blade 136. The first blade 134 may be at an angle with respect to the edge 124 or central axis 125 that is approximately the same as the angle of the blades 114 of the first portion 128 with respect to the edge 124 or central axis 125. In addition, the second blade 136 may be at an angle with respect to the edge 124 or central axis 125 that is approximately the same as the angle of the blades 114 of the second portion 130 with respect to the edge 124 or central axis 125. In this manner, for air flow that is directed through the louver assembly 100 toward the sleeve 102, a portion of air flow that is directed across the first blade 134 and the first portion 128 of blades 114 may be directed in a first direction 138 through the louver assembly 100, while another portion of air flow that is directed across the second blade 136 and the second portion 130 of blades 114 may be directed in a second direction 140 through the louver assembly 100. In additional or alternative embodiments, for air flow that is directed from the sleeve 102 and across the louver assembly 100, a portion of air flow that is directed across the first blade 134 and the first portion 128 of blades 114 may be directed in a direction opposite the first direction 138 through the louver assembly 100, while another portion of air flow that is directed across the second blade 136 and the second portion 130 of blades 114 may be directed in a direction opposite the second direction 140 through the louver assembly 100.

To further enhance direction of the air flow through the louver assembly 100, the second end frame 106 may also include an inclined surface 127 that is disposed at an angle with respect to the edge 124 or central axis 125. The angle of the inclined surface 127 may be approximately the same as the angle of the blades 114 of the second portion 130 with respect to the edge 124 or central axis 125. Similarly, in certain embodiments, the first end frame 104 may include an inclined or declined surface, which may be disposed an angle relative to the edge 124 or central axis 125 that is the same or similar to the angle of the blades 114 of the first portion 128.

In certain embodiments, the sleeve 102 may include a first section 142 and a second section 144 that are generally vertically arranged relative to one another in an installed position. Air that flows through the first section 142 may be independent of air that flows through the second section 144. For example, air may be directed to and/or from a certain section of the HVAC unit 12 through the first section 142, and air may be directed to and/or from a different section of the HVAC unit 12 through the second section 144. To this end, the sleeve 102 and/or the HVAC unit 12 may include a partition or divider 145 fluidly separating the first section 142 and the second section 144. In some embodiments, air flow that is directed across the first portion 128 of blades 114 may be directed to and/or from the first section 142 of the sleeve 102. Meanwhile, air flow that is directed across the second portion 130 of blades 114 may be directed to and/or from the second section 144 of the sleeve 102.

It should be understood that, although FIG. 2 illustrates two sections 142, 144 corresponding to two portions 128, 130 of blades 114, there may be any suitable number of sections and corresponding portions of blades 114, each of which may have the same or different angled orientations. Accordingly, there may be any number of transition blades 132 that may each be positioned between adjacent portions of blades 114 having different angles. Furthermore, blades 114 positioned at different angles may be disposed adjacent to one another along the second length 118. In other words, instead of grouping together blades 114 positioned at substantially the same angle and using transition blades 132 to separate groups of blades 114 positioned at different angles, blades 114 of different angles may be disposed adjacent to one another or in an alternating arrangement without a transition blade 132 in an alternating or in a random arrangement.

It should also be appreciated that air may be directed into a single section of the sleeve 102 at different angles. In other words, a single section of the sleeve 102 may be in fluid communication with blades 114 of the louver assembly 100 that are positioned at different angles. For example, the sleeve 102 may include a single section instead of the first section 142 and the second section 144. Accordingly, air flow through the first portion 128 of blades 114 and air flow through the second portion 130 of blades may flow through the same section of the sleeve 102.

Figure 3:
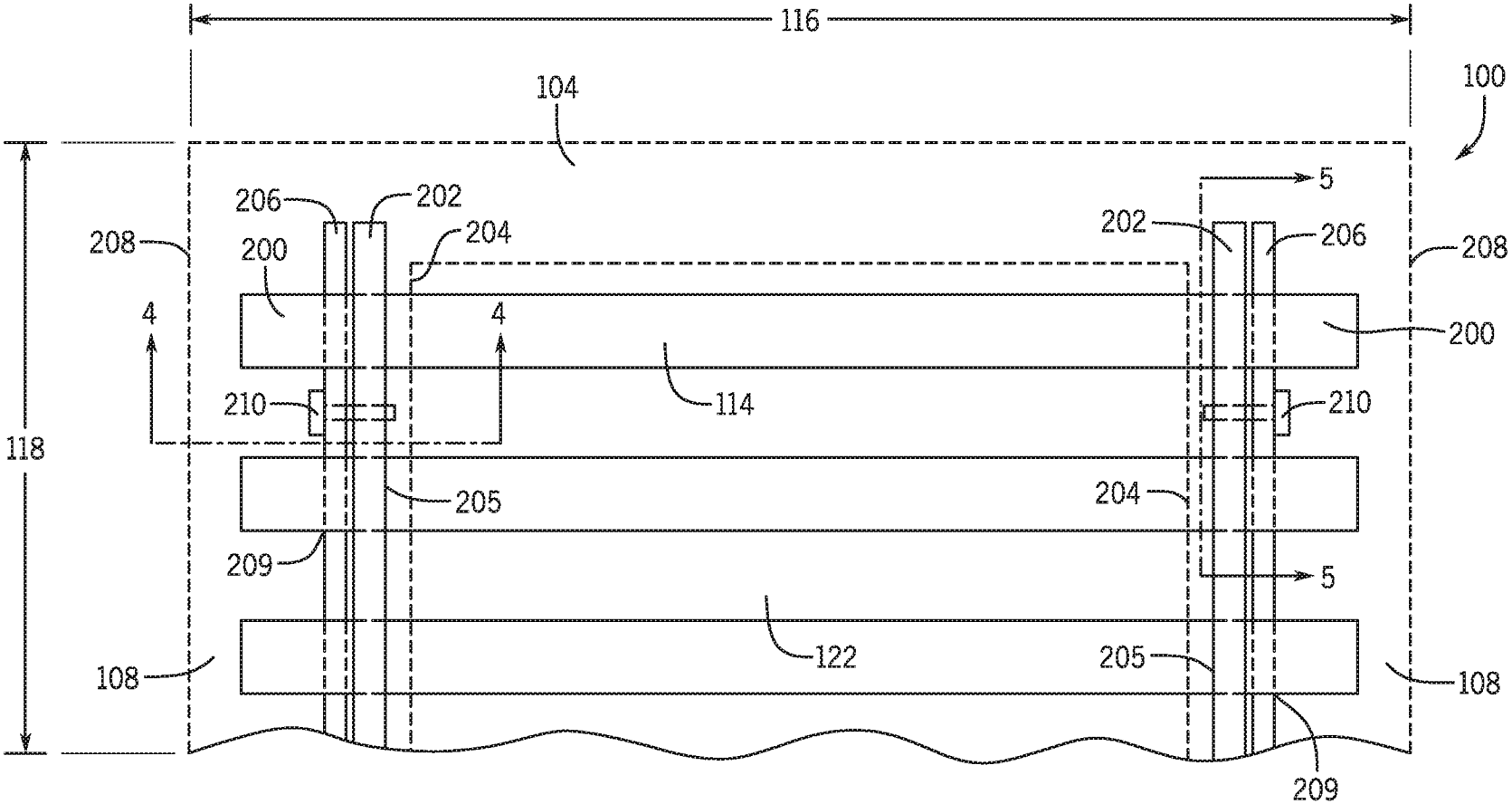
FIG. 3 is a partial front view of an embodiment of the louver assembly of FIG. 2, illustrating end supports and retention inserts to secure blades of the louver assembly to a frame of the louver assembly, in accordance with an aspect of the present disclosure.

FIG. 3 is a partial front view of an embodiment of the louver assembly 100 of FIG. 2. In FIG. 3, the first end frame 104 and the jamb frames 108 are hidden to illustrate the coupling of the blades 114 within the jamb frames 108. As indicated in FIG. 3, each blade 114 includes two retention ends 200 disposed on opposite ends of the blade 114. Each retention end 200 of each blade 114 is positioned in one of the jamb frames 108. Specifically, the retention ends 200 of each blade 114 are each inserted through a respective end support 202 disposed and secured within in each jamb frame 108. Each end support 202 may be positioned adjacent to a respective inside face 204 of the jamb frame 108 retaining the end support 202, where the inside face 204 is in contact with or exposed to the air flow directed through the louver assembly 100. Each end support 202 may extend along at least a portion of the second length 118 of the jamb frame 108.

The end supports 202 each include blade apertures 205 formed through the end support 202. As shown in the illustrated embodiment, each retention end 200 may be inserted through a respective blade aperture 205 of one of the end supports 202 to be captured and supported by the end support 202 within the jamb frame 108. More specifically, each blade 114 includes two retention ends 200, as noted above, and one retention end 200 may be inserted into one of the blade aperture 205 of one end support 202, while the other retention end 200 of the blade 114 is inserted into one of the blade apertures 205 of the other end support 202. The blade apertures 205 may have a shape substantially similar to a profile of each blade 114 to block movement of each blade 114 when the blades 114 are inserted through the respective blade apertures 205. For example, the blades 114 may be slip fit through the respective blade apertures 205 to be removably coupled to the end support 202. That is, the position of the blades 114 may be adjusted along the second length 116 through the blade apertures 205 to be positioned within the blade apertures 205 or be removed from the blade apertures 205. Additionally or alternatively, the blades 114 may be press fit through the respective blade apertures 205 to be more permanently and more securely coupled to the end supports 202.

Moreover, a retention insert 206 may be disposed within each jamb frame 108. More specifically, the retention insert 206 is positioned through each blade 114 between the end support 202 and an outside face or portion 208 of the jamb frame 108. To enable this arrangement of components, the retention ends 200 of each blade 114 may each include a retention aperture 209 formed through the blade 114, and the retention insert 206 may extend through the retention aperture 209. In particular, when the retention ends 200 of each blade 114 are positioned through respective blade apertures 205 of the end support, the retention apertures 209 of the retention ends 200 may be aligned with one another along the second length 118, and the retention insert 206 may then extend through all of the retention apertures 209 of the retention ends 200 in the jamb frame 108. Each retention insert 206 may extend along at least a portion of the second length 118 of the jamb frame 108 and along the adjacent end support 202 to be inserted through the blades 114 of the louver assembly 100. It should be understood that the end support 202 may extend a greater length, a short length, or a substantially similar length compared to the retention insert 206. In some embodiments, a length of the end support 202 and/or retention insert 206 may be between 60 centimeters and 85 centimeters.

In certain embodiments, the retention insert 206 may be coupled or fastened to the adjacent end support 202, such as via a fastener 210 implemented to compress the retention insert 206 and the end support 202 against one another. In this manner, the fastener 210 may improve securement of the blade 114 to the end support 202 within the jamb frame 108. The fastener 210 may be inserted through the retention insert 206 and the end support 202, but may not extend beyond the inside face 204 into the opening 122 to avoid affecting an air flow through the louver assembly 100. In some embodiments, the fastener 210 may be positioned along the second length 118 proximate to the first end frame 104, proximate to the second end frame 106, both, and/or between any adjacent blades 114 along the length 118. There may be any number of fasteners 210 used to secure the retention insert 206 and the end support 202 together. Although FIG. 3 illustrates the two jamb frames 108 having fasteners 210 that are aligned with one another along the first length 116, it should be appreciated that different jamb frames 108 may include fasteners 210 that are disposed at different positions along the second length 118 than one another. In other words, one jamb frame 108 may include one fastener 210 disposed along the second length 118 at a first position and another jamb frame 108 may include another fastener 210 disposed along the second length 118 at a second position, where the first position is different than the second position.

In general, each jamb frame 108 may include one of the end supports 202 disposed within the jamb frame 108 adjacent to the inside face 204 and extending along the second length 118. One retention end 200 of each blade 114 of the louver assembly 100 may be inserted through one of the blade apertures 205 of the end support 202 to couple the blade 114 to the end support 202, and thereby to the jamb frame 108. Moreover, one of the retention inserts 206 may be disposed through each retention aperture 209 of the respective retention ends 200 of each blade 114 inserted into the end support 202 of the jamb frame 108. The retention insert 206 may further be fastened or secured to the end support 202. In this manner, the rigidity and stiffness of the blades 114 and the louver assembly 100 may be improved and able to withstand impact from debris that may contact the blades 114 and/or the louver assembly 100.

In addition, in certain embodiments, the end support 202 and/or the retention strip 206 may be retrofitted to existing louver assemblies 100. In other words, in existing louver assemblies 100, the blades 114 may each be modified to include the retention aperture 209 and the retention insert 206 may be disposed through the added retention apertures 209 of the blades 114. Additionally or alternatively, respective end supports 202 may be disposed within the jamb frames 108 of existing louver assemblies 100, and the blades 114 may be inserted through the blade apertures 205 of the added end supports 202. In this manner, existing louver assemblies 100 may be modified to reinforce the blades 114 within the jamb frames 108.

Figure 4:
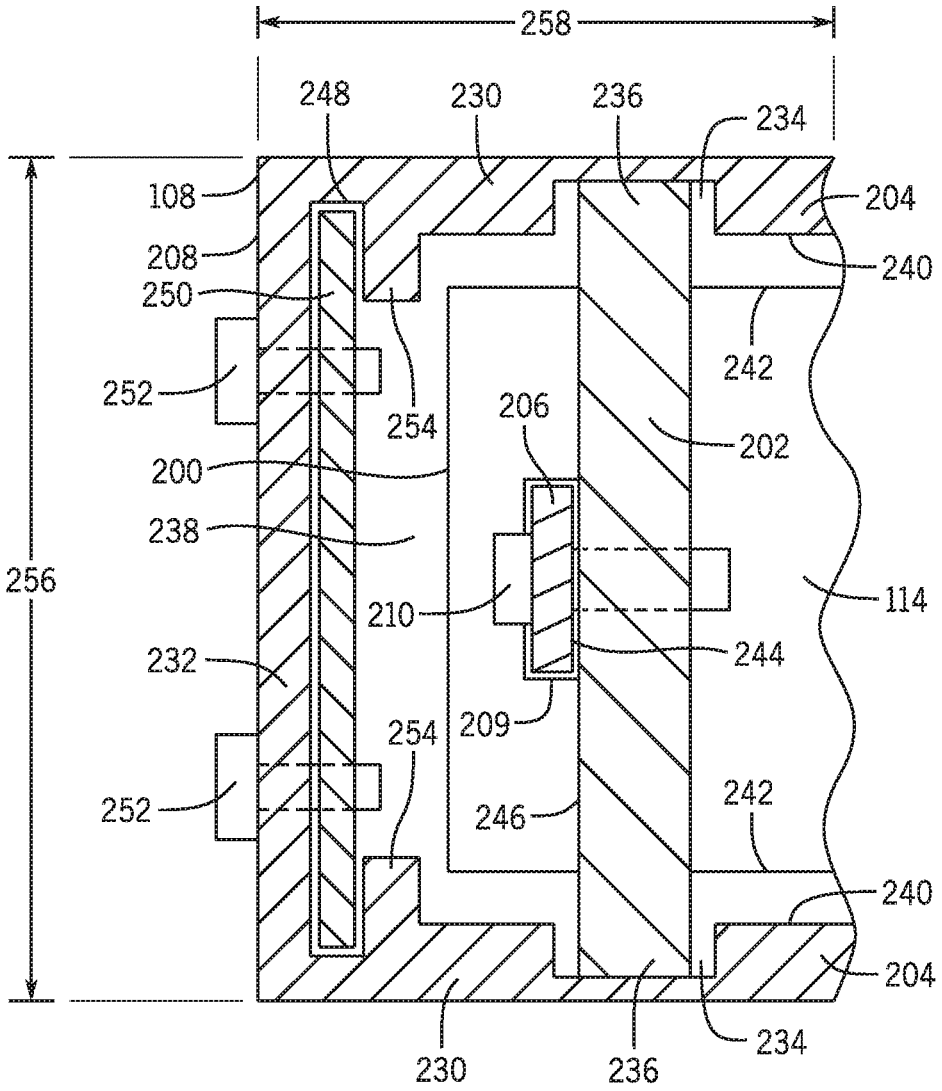
FIG. 4 is a cross-sectional top view, taken along line 4-4 of FIG. 3, of an embodiment of a louver assembly, in accordance with an aspect of the present disclosure.

FIG. 4 is a partial cross-sectional top view, taken along line 4-4 of FIG. 3, of an embodiment of the louver assembly 100. As shown in FIG. 4, the jamb frame 108 may include a generally U-shaped cross-section. The U-shaped cross-section includes two arms 230 extending laterally from and substantially perpendicular to a base side 232. Each arm 230 may include a recess 234 that respective ends 236 of the end support 202 may be disposed therein. The respective recesses 234 of the arms 230 of the jamb frame 108 may be disposed generally opposite to one another to enable the end support 202 to be positioned generally parallel to the outside face 208 of the base side 232. In certain embodiments, the ends 236 may have a shape or profile substantially similar to the recesses 234 to block movement of the end support 202 when inserted into the recesses 234. In other words, when the ends 236 of the end support 202 are inserted into respective recesses 234 of the arms 230, the end support 202 may be retained or secured within the jamb frame 108 in a direction along the first length 116. For example, the end support 202 may press fit or slip fit into the recesses 234 to secure the position of the end support 202 within the jamb frame 108.

The blades 114 may be inserted through the end support 202 and may be positioned in a center section 238 of the jamb frame 108 formed between the two arms 230. In certain embodiments, the center section 238 may include a shape or profile substantially similar to the shape of the blades 114 to block movement of the blades 114 within the center section 238 and/or to block air flow into the jamb frame 108 between inner surfaces 240 of the arms 230 and an edge 242 of the blades 114.

As previously noted, each blade 114 may include the retention aperture 209 to receive the retention insert 206. The retention aperture 209 may have a substantially similar shape or profile as the retention insert 206. As a result, the retention aperture 209 and the retention insert 206 may cooperatively engage with one another to block movement of the retention insert 206 within the retention aperture 209 along a lateral or transverse direction. For example, the retention insert 206 may slip fit or press fit into the retention aperture 209.

As illustrated in FIG. 4, the retention insert 206 may be positioned to enable a surface 244 of the retention insert 206 to abut against a surface 246 of the end support 202. The fastener 210 may further secure the retention insert 206 against the surface 244 by compressing the retention insert 206 and the end support 202 together. The fastener 210 may be a rivet, a screw, a clamp, a combination of a nut and a bolt, a pin, another suitable fastener, or any combination thereof. In certain embodiments, the fastener 210 is a more permanent fastener, such as a weld, an adhesive, or the like. As illustrated in FIG. 4, the retention insert 206 and the end support 202 are generally rectangular in shape to enable the surface 244 of the retention insert 206 to abut the surface 246 of the end support 202 securely and/or for the fastener 210 to be inserted through the end support 202 and the retention insert 206. However, it should be understood that the end support 202 and/or the retention insert 206 may be of another shape, such as parallelogramatic, hexagonal, or any other suitable shape.

In certain embodiments, the jamb frame 108 may also include slots 248 proximate to the base side 232, which may facilitate coupling of the first end frame 104 and/or the second end frame 106 to the jamb frame 108. Specifically, the first end frame 104 and/or the second end frame 106 may include a flange 250 that may be inserted into the slots 248. Fasteners 252, which may be of the same type of fastener as the fasteners 210, may then couple the flange 250 to the base side 232 and secure the first end frame 104 and/or the second end frame 106 to the jamb frame 108. In additional or alternative embodiments, the flange 250 may be coupled to the base side 232 via crimping, punching, welding, another method, or any combination thereof. The slots 248 may be of a substantially similar shape as the flange 250 to block movement of the flange 250 within the slots 248. In some embodiments, the arms 230 may include extensions 254 adjacent to the slots 248, which are implemented to secure the flange 250 within the slots 248 and to block contact between the flange 250 and the blades 114. In other words, the extensions 254 block the flange 250 from shifting into the center section 238 and also block the blades 114 from shifting into the slots 248.

The jamb frame 108 may include a jamb frame length 256, and the arms 230 may each include an arm length 258, which may be sized to accommodate the end support 202, the retention insert 206, and the flange 250. For example, the jamb frame length 256 may be between 3 centimeters and 5 centimeters and the arm length 258 may be between 2 centimeters and 5 centimeters. It should be understood that, although FIG. 4 illustrates both arms 230 of a jamb frame 108 as being approximately equal to one another, in other embodiments, the arms 230 of the jamb frame 108 may include arms 230 having different arm lengths 258. For example, one of the arms 230 may be implemented to be fastened to the sleeve 102 and may include a different arm length 258, such as a substantially longer arm length 258 than the arm length 258 of the other arm 230, to facilitate fastening of the louver assembly 100 to the sleeve 102.

It should be understood that the first end frame 104, the second end frame 106, the jamb frames 108, the blades 114, the end supports 202, and the retention inserts 206 may be of the same or a substantially similar material. For example, the first end frame 104, the second end frame 106, the jamb frames 108, the blades 114, the end supports 202, and the retention inserts 206 may include a metallic alloy, a composite, a polymer, or any combination thereof. Indeed, the described components may be formed from any suitable strong and/or durable materials. Additionally, it should be understood that, although FIG. 4 illustrates the jamb frame 108 having one retention insert 206 disposed therein, any number of retention inserts 206 may be disposed through respective retention apertures 209 of the blades 114, and there may be any number of corresponding fasteners 210 to couple the respective retention inserts 206 to the end support 202. Furthermore, although FIGS. 3 and 4 depict the retention insert 206 positioned between the end support 202 and the outside face 208 of the jamb frame 108, the retention insert 206 may additionally or alternatively be positioned between the end support 202 and the inside face 204 of the jamb frame 108.

Figure 5:
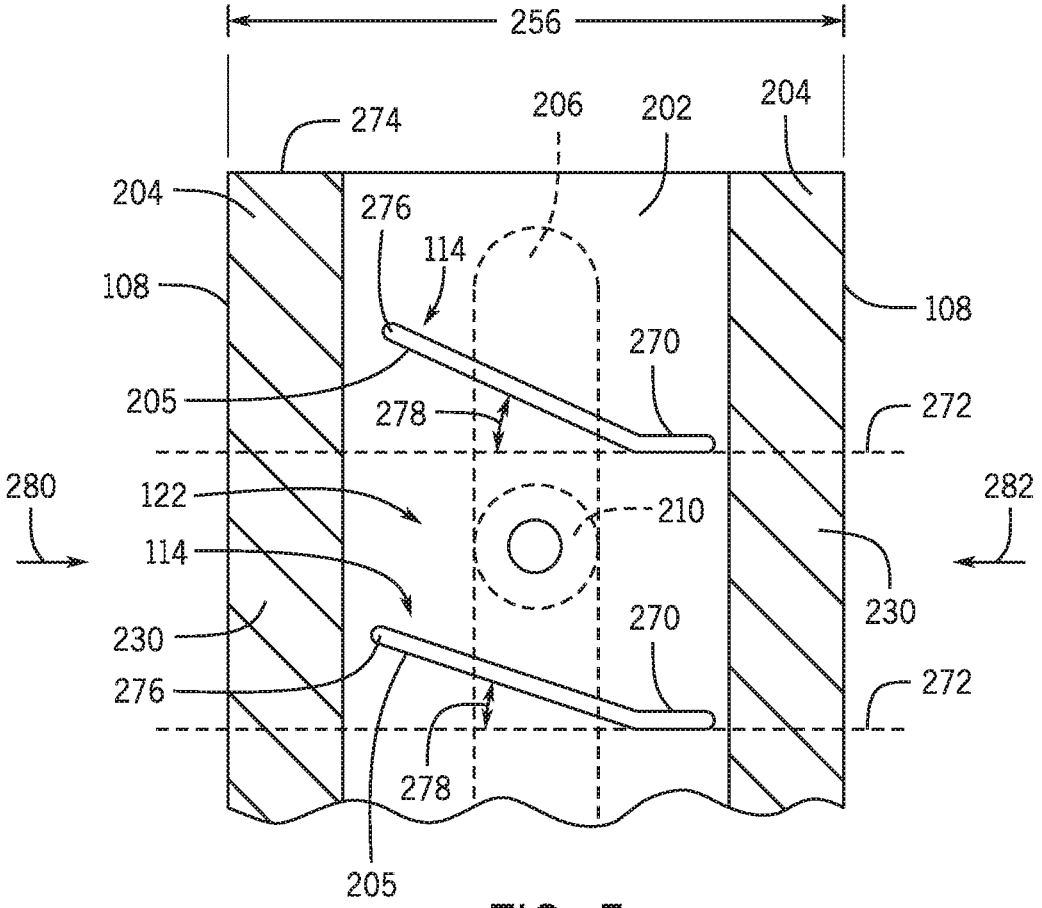
FIG. 5 is a cross-sectional side view, taken along line 5-5 of FIG. 3, of an embodiment of a louver assembly, in accordance with an aspect of the present disclosure.

FIG. 5 is a partial cross-sectional side view, taken along line 5-5 of FIG. 3, of an embodiment of the louver assembly 100. As mentioned above, the end support 202 includes the plurality of blade apertures 205. When the end support 202 is positioned within the jamb frame 108 in the manner described above, the blade apertures 205 are disposed between the arms 230 of the jamb frame 108. By way of example, the blade apertures 205 may be positioned or formed within the end support 202 to enable the blades 114 to be substantially centered between the arms 230 when the blades 114 are inserted into respective blade apertures 205.

As illustrated in FIG. 5, each blade 114 may include a first segment 270. When the blade 114 is disposed within one of the blade apertures 205, the first segment 270 may be generally parallel to an axis 272 extending across the arms 230 of the jamb frame 108 through the end support 202, where the axis 272 may be generally parallel to the edge 124 of the jamb frame 108 or the central axis 125 of the louver assembly 100. Additionally, each blade 114 may include a second segment 276. In an installed position within one of the blade apertures 205, the second segment 276 may be disposed at an angle 278 with respect to the axis 272. The first segment 270 and the second segment 276 may achieve, improve, or enhance a desired air flow through the openings 122 between adjacent blades 114. For example, for air flow directed in a direction 280 through the louver assembly 100, the angle of the second section 272 may block unwanted particles from passing through the openings 122, and the first segment 270 may redirect the air flow to flow in the direction 280 after being directed through the openings 122. For air flow passing in a direction 282 through the opening 122, the combination of the first segment 270 and the second segment 276 may facilitate directing the air flow at the angle 278 when the air flow exits the louver assembly 100.

As previously noted, the louver assembly 100 may include portions or sets 128, 130 of blades 114, where the angle 278 between the blades 114 and the axis 272 may be different between the different portions 128, 130. For example, the angle 278 may range between 10° and 50°. It should also be understood that the shape of each blade 114, and therefore each blade aperture 205, may be different than depicted in FIG. 5 and may also be different than one another at different sections of the louver assembly 100, such as in the different portions 128, 130.

In the illustrated embodiment, the retention insert 206 extends through the second segment 276 of each blade 114. Therefore, the respective blade aperture 205 of each blade 114 is formed in the second segment 276. As will be appreciated, extension of the retention insert 206 through an angled section of each blade 114, such as the second segment 276, may further improve the securement, rigidity, and/or strength of the coupling between the blades 114, the retention insert 206, and the end support 202. Indeed, such a configuration may enable additional surface area contact between the blades 114 and the retention insert 206 compared to retention inserts 206 extending through blades 114 in a substantially perpendicular orientation. Nevertheless, in some embodiments, the blade apertures 205 may be formed in the first segment 270 extending generally parallel to the axis 272. Thus, the retention insert 206 may extend through the blade 114 perpendicularly. In other embodiments, the blade apertures 205 may be formed across an intersection between the first segment 270 and the second segment 276, and the retention insert 206 may therefore extend through both the first segment 270 and the second segment 276.

As set forth above, embodiments of the present disclosure may provide one or more technical effects useful in the operation of HVAC systems. For example, an HVAC system may include a louver assembly with blades reinforced to a frame of the louver assembly. Air may be directed through openings between adjacent blades, where the blades direct the air in a desired manner through the louver assembly and/or block unwanted particles from being directed through the louver assembly. Each blade may be inserted through one or more end supports disposed in the frame and a retention insert may extend through each of the blades to secure the blade to and within the end support. Furthermore, the end support and the retention insert may be fastened to one another to further secure the blade within the frame. The reinforcement of the blades within the frame of the louver assembly may enable the blades to withstand impact of certain debris, such as debris traveling at high speed and/or heavy debris. Specifically, the disclosed embodiments enable the blades to remain secured within the frame of the louver assembly while the integrity of the openings between the adjacent blades is maintained during and after debris impact. As such, the blades may continue to direct air flow through the louver assembly and/or continue to block unwanted particles from being directed through the louver assembly after debris impact. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures, pressures, and so forth, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A louver assembly, comprising:

a jamb frame comprising a retention recess;

a support extending within the retention recess of the jamb frame and along a length of the jamb frame, wherein the support comprises a plurality of blade apertures formed therethrough;

a plurality of louver blades, wherein each louver blade of the plurality of louver blades has a retention aperture formed therethrough, and wherein each louver blade of the plurality of louver blades extends through a respective blade aperture of the plurality of blade apertures and transversely with respect to the length of the jamb frame;

an insert extending through the retention aperture of each louver blade of the plurality of louver blades; and a fastener extending through the insert and the support, wherein the fastener is configured to compress the insert and the support against one another and fasten the insert to the support to block movement of the plurality of louver blades.

2. The louver assembly of claim 1, wherein the fastener is disposed between adjacent louver blades of the plurality of louver blades.

3. The louver assembly of claim 1, wherein the support is a first support, the plurality of blade apertures is a first plurality of blade apertures, the retention aperture is a first retention aperture, and the insert is a first insert, and wherein the louver assembly further comprises:

a second support comprising a second plurality of blade apertures; and a second insert, wherein each louver blade of the plurality of louver blades comprises a second retention aperture, and the second insert is configured to extend through the second retention aperture of each louver blade.

4. The louver assembly of claim 3, wherein the first retention aperture and the second retention aperture are formed in opposite retention ends of the respective louver blade.

5. The louver assembly of claim 1, wherein a length of the insert extends along a length of the support between the jamb frame and the support.

6. The louver assembly of claim 1, wherein a louver blade of the plurality of louver blades comprises a first segment extending along a length of the louver blade and a second segment extending along the length of the louver blade, wherein the first segment and the second segment are disposed at an angle relative to one another.

7. The louver assembly of claim 6, wherein the first segment is oriented in a direction along a central axis of the louver assembly, the central axis extends longitudinally through a laterally and vertically central point of the louver assembly, and the second segment is oriented in a direction crosswise to the central axis of the louver assembly.

8. The louver assembly of claim 7, wherein the respective retention aperture of the louver blade is formed through the second segment.

9. The louver assembly of claim 1, wherein the retention aperture and the insert each comprise a rectangular shape.

10. The louver assembly of claim 1, wherein the insert is configured to engage with each louver blade of the plurality of louver blades via the retention aperture of each louver blade of the plurality of louver blades to block movement of the insert along a transverse direction of the louver assembly.

11. A louver assembly, comprising:

a jamb frame extending along a lateral side of the louver assembly, wherein the jamb frame comprises a base and arms extending laterally from opposite ends of the base, wherein each arm comprises a recess;

a support extending along the lateral side and the jamb frame of the louver assembly and having a plurality of blade apertures formed therethrough, wherein the support extends into the recess of each arm of the jamb frame;

a plurality of blades, wherein each blade of the plurality of blades has a retention aperture formed therethrough, and wherein each blade of the plurality of blades extends through a respective blade aperture of the plurality of blade apertures;

an insert extending through the retention aperture of each blade; and a fastener extending through and contacting the support and the insert to secure the support and the insert to one another.

12. The louver assembly of claim 11, wherein the plurality of blades comprises a first plurality of blades, wherein each blade of the first plurality of blades is oriented at a first angle relative to a central axis of the louver assembly, the central axis extends longitudinally through a laterally and vertically central point of the louver assembly, wherein the plurality of blades comprises a second plurality of blades, wherein each blade of the second plurality of blades is oriented at a second angle relative to the central axis of the louver assembly, wherein the first angle is different from the second angle.

13. The louver assembly of claim 12, wherein the plurality of blades comprises a transition blade having a first blade portion oriented at the first angle relative to the central axis of the louver assembly and having a second blade portion oriented at the second angle relative to the central axis of the louver assembly, wherein the transition blade is positioned between the first plurality of blades and the second plurality of blades along a length of the jamb frame.

14. The louver assembly of claim 11, wherein the insert extends along a length of the jamb frame between the base of the jamb frame and the support.

15. The louver assembly of claim 11, wherein the insert abuts the support.

16. The louver assembly of claim 11, wherein the jamb frame comprises a slot proximate to the base, and wherein the louver assembly further comprises an end frame having a length extending along a length of the plurality of blades and having a flange extending into the slot to couple the end frame to the base.

17. A louver assembly for a heating, ventilation, and/or air conditioning (HVAC) system, comprising:

a support extending along a length and having a plurality of louver blade apertures formed therethrough;

a jamb frame comprising a retention recess configured to capture the support, wherein the support extends within the jamb frame along the length;

a plurality of louver blades, wherein each louver blade of the plurality of louver blades has a retention aperture formed therethrough, and wherein each louver blade of the plurality of louver blades extends through a respective louver blade aperture of the plurality of louver blade apertures;

an insert extending through the retention aperture of each louver blade of the plurality of louver blades, wherein the insert abuts the support; and a fastener extending through the support and the insert to secure and compress the insert and the support against one another.

18. The louver assembly of claim 17, wherein the fastener comprises a rivet, a screw, a clamp, a bolt, a pin, a weld, an adhesive, or any combination thereof.

19. The louver assembly of claim 17, wherein the jamb frame comprises a base and two arms extending laterally from opposite ends of the base, wherein one arm of the two arms is configured to mount the louver assembly to an air handler of the HVAC system.

20. The louver assembly of claim 17, wherein the retention aperture and the insert each comprise a rectangular cross-section.

21. The louver assembly of claim 17, wherein the support and the insert comprise a metallic alloy, a composite, a polymer, or any combination thereof.

22. The louver assembly of claim 17, wherein a set of louver blades of the plurality of louver blades is oriented at an angle relative to a central axis of the louver assembly, wherein the central axis extends longitudinally through a laterally and vertically central point of the louver assembly.

* * * * *